US006225951B1

(12) United States Patent
Holshouser et al.

(10) Patent No.: US 6,225,951 B1
(45) Date of Patent: May 1, 2001

(54) ANTENNA SYSTEMS HAVING CAPACITIVELY COUPLED INTERNAL AND RETRACTABLE ANTENNAS AND WIRELESS COMMUNICATORS INCORPORATING SAME

(75) Inventors: Howard E. Holshouser, Efland; Gary G. Sanford, Apex, both of NC (US)

(73) Assignee: Telefonaktiebolaget L.M. Ericsson (SE)

( * ) Notice: Subject to any disclaimer, the term of this patent is extended or adjusted under 35 U.S.C. 154(b) by 0 days.

(21) Appl. No.: 09/585,514

(22) Filed: Jun. 1, 2000

(51) Int. Cl.[7] ..... H01Q 1/38
(52) U.S. Cl. ..... 343/700 MS; 343/702; 343/725
(58) Field of Search ..... 343/700 MS, 702, 343/725, 729, 829, 846, 872, 900, 895; H01Q 1/38

(56) References Cited

U.S. PATENT DOCUMENTS 5,434,579 * 7/1995 Kagoshima et al. ..... 343/700 MS
5,684,492 * 11/1997 Kagoshima et al. ..... 343/700 MS
5,777,586 * 7/1998 Luxon et al. ..... 343/702
5,812,097 * 9/1998 Maldonado ..... 343/790
5,952,975 * 9/1999 Pedersen et al. ..... 343/702
6,075,489 * 6/2000 Sullivan ..... 343/702
6,097,339 * 8/2000 Filipovic et al. ..... 343/702
6,137,998 * 10/2000 Holshouser et al. ..... 343/702

* cited by examiner

*Primary Examiner*—Tho Phan
(74) *Attorney, Agent, or Firm*—Myers Bigel Sibley Sajovec

(57) ABSTRACT

Antenna systems for use within wireless communication devices such as radiotelephones are provided and include an internal multi-frequency band antenna and an elongated antenna member that is retractable. The elongated antenna member is extendible from the housing of a communications device so as to have an extended position and a retracted position. The elongated antenna member includes an elongated conductive element that is capacitively coupled with the multi-frequency band antenna when the elongated antenna member is in the extended position. The multi-frequency band antenna is electrically isolated from the elongated conductive element when the elongated antenna member is in the retracted position. When the elongated antenna member is in an extended position, the elongated conductive element is configured to resonate as a half-wave monopole antenna when the internal antenna resonates within a first frequency band. The elongated conductive element is configured to resonate as a full-wave monopole antenna when the internal antenna resonates within a second frequency band.

26 Claims, 4 Drawing Sheets

ANTENNA SYSTEMS HAVING CAPACITIVELY COUPLED INTERNAL AND RETRACTABLE ANTENNAS AND WIRELESS COMMUNICATORS INCORPORATING SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals.

Radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones. Inverted-F antennas may be well suited for use within the confines of radiotelephones, particularly radiotelephones undergoing miniaturization. As is well known to those having skill in the art, conventional inverted-F antennas include a conductive element that is maintained in spaced apart relationship with a ground plane. Examples of conventional inverted-F antennas are described in U.S. Pat. Nos. 5,684,492 and 5,434,579 which are incorporated herein by reference in their entirety.

In addition, it may be desirable for radiotelephones to operate within multiple frequency bands in order to utilize more than one communications system. For example, GSM (Global System for Mobile communication) is a digital mobile telephone system that typically operates at a low frequency band, such as between 880 MHz and 960 MHz. DCS (Digital Communications System) is a digital mobile telephone system that typically operates at high frequency bands, such as between 1710 MHz and 1880 MHz. The frequency bands allocated in North America are 824–894 MHz for Advanced Mobile Phone Service (AMPS) and 1850–1990 MHz for Personal Communication Services (PCS). Accordingly, internal antennas, such as inverted-F antennas are being developed for operation within multiple frequency bands.

There is also interest in utilizing retractable antennas that can be extended from communications devices, such as radiotelephones. Retractable antennas may enhance signal transmission and reception, particularly in communications devices utilizing code-division multiple access (CDMA) wireless telephone transmission technologies. Unfortunately, communications devices that utilize both internal antennas and retractable antennas may require complex switching schemes which, in turn, may increase manufacturing costs and may present reliability concerns.

SUMMARY OF THE INVENTION

In view of the above discussion, antenna systems for use within wireless communication devices such as radiotelephones are provided. An antenna system according to an embodiment of the present invention includes a multi-frequency band antenna disposed within a housing of a communications device, such as a radiotelephone. The multi-frequency band antenna is electrically connected with a transceiver within the housing (or with a receiver and/or a transmitter within the housing). An elongated antenna member is movably mounted within the housing and is extendible from the housing so as to have an extended position and a retracted position.

The elongated antenna member includes an elongated conductive element that is capacitively coupled with the multi-frequency band antenna when the elongated antenna member is in the extended position. The multi-frequency band antenna is electrically isolated from the elongated conductive element when the elongated antenna member is in the retracted position.

The multi-frequency band antenna is configured to resonate within a first (i.e., low) frequency band having a first central frequency and within a second (i.e., high) frequency band having a second central frequency, wherein the second central frequency is greater than the first central frequency. When the elongated antenna member is in an extended position, the elongated conductive element is configured to resonate as a half-wave monopole antenna when the multi-frequency band antenna resonates within the first frequency band. Also, when the elongated antenna member is in an extended position, the elongated conductive element is configured to resonate as a full-wave monopole antenna when the multi-frequency band antenna resonates within the second frequency band.

Antenna systems according to the present invention may be particularly well suited for use within a variety of communications systems utilizing different frequency bands. Furthermore, the combination of an internal multi-frequency band antenna and a retractable antenna member according to the present invention may not require complex switching mechanisms. In addition, antenna systems according to the present invention may not require additional impedance matching networks, which may save internal radiotelephone space and which may lead to manufacturing cost savings.

DETAILED DESCRIPTION OF THE INVENTION

Figure 1:
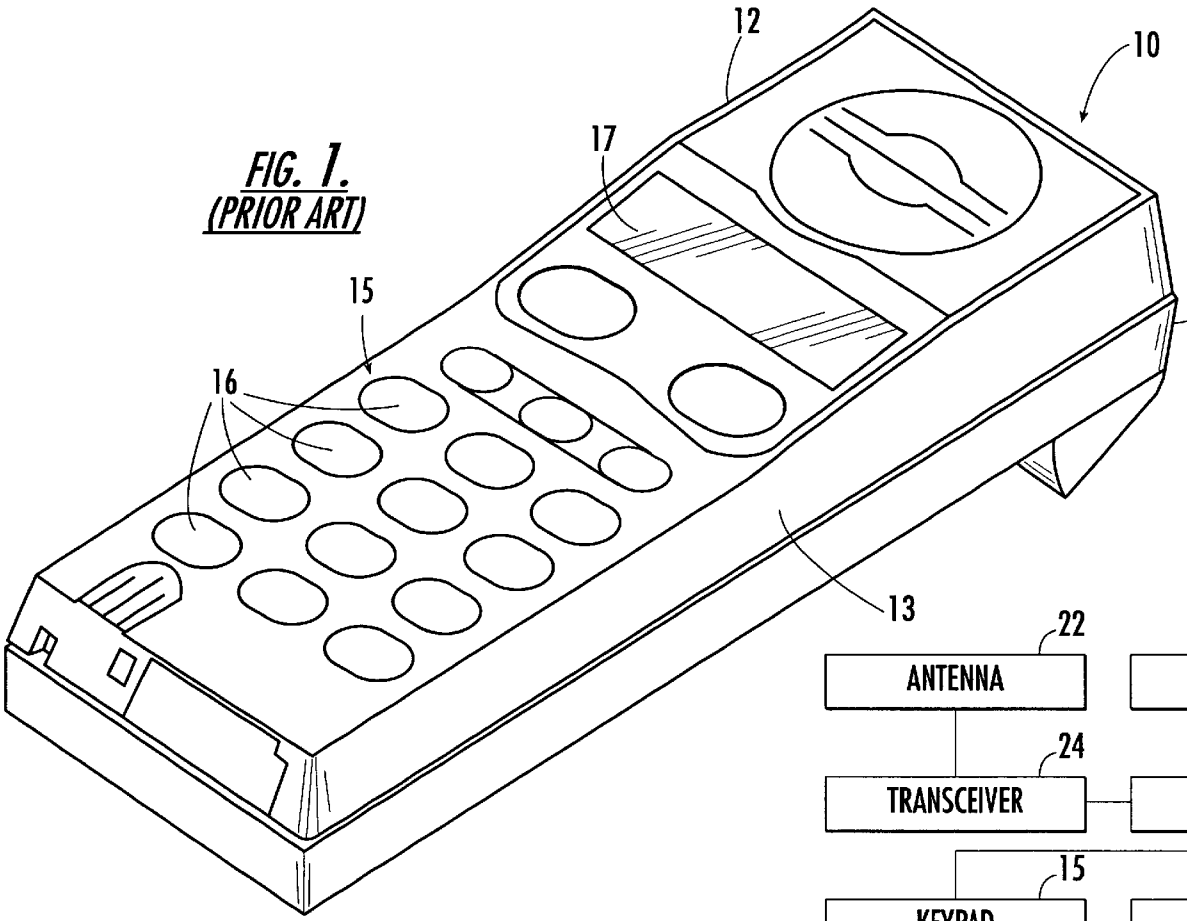
FIG. 1. (PRIOR ART)
FIG. 1 is a perspective view of an exemplary radiotelephone within which antennas according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of lines, layers and regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present.

Referring now to FIG. 1, a radiotelephone 10, within which antenna systems according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

It is understood that antenna systems according to the present invention may be utilized within various types of wireless communications devices and are not limited to radiotelephones. Antenna systems according to the present invention may also be used with wireless communications devices which only transmit or receive wireless communications signals. Such devices which only receive signals may include conventional AM/FM radios or any receiver utilizing an antenna. Devices which only transmit signals may include remote data input devices.

Figure 2:
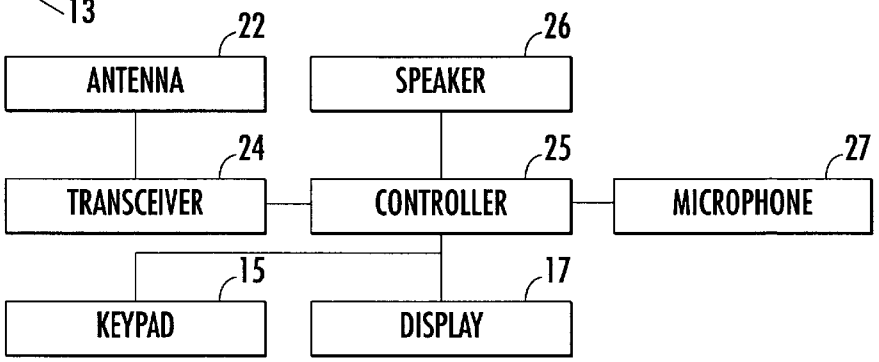
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency (RF) transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna may depend on its aperture area and typically is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components to provide a 50 Ohm (Ω) (or desired) impedance value at the feed point.

Figure 3:
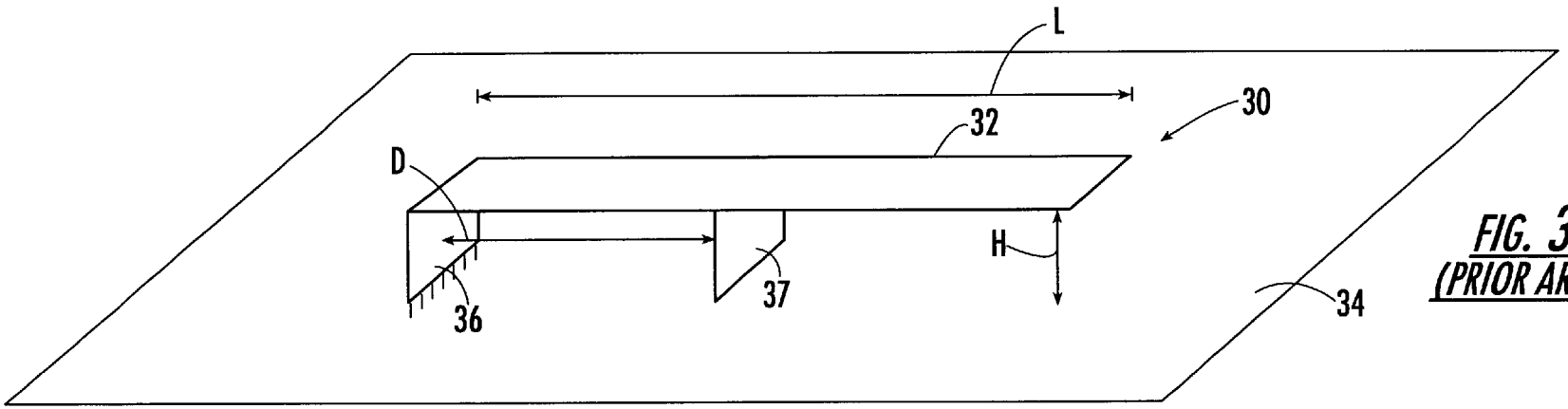
FIG. 3. (PRIOR ART)
FIG. 3 is a perspective view of a conventional planar inverted-F antenna.

Referring now to FIG. 3, a conventional planar inverted-F antenna 30 is illustrated. The illustrated antenna 30 includes a linear conductive element 32 maintained in spaced apart relationship with a ground plane 34. Conventional inverted-F antennas, such as that illustrated in FIG. 3, derive their name from a resemblance to the letter "F." The conductive element 32 is grounded to the ground plane 34 as indicated by 36. An RF connection 37 extends from RF circuitry underlying or overlying the ground plane 34 to the conductive element 32.

Figure 4A:
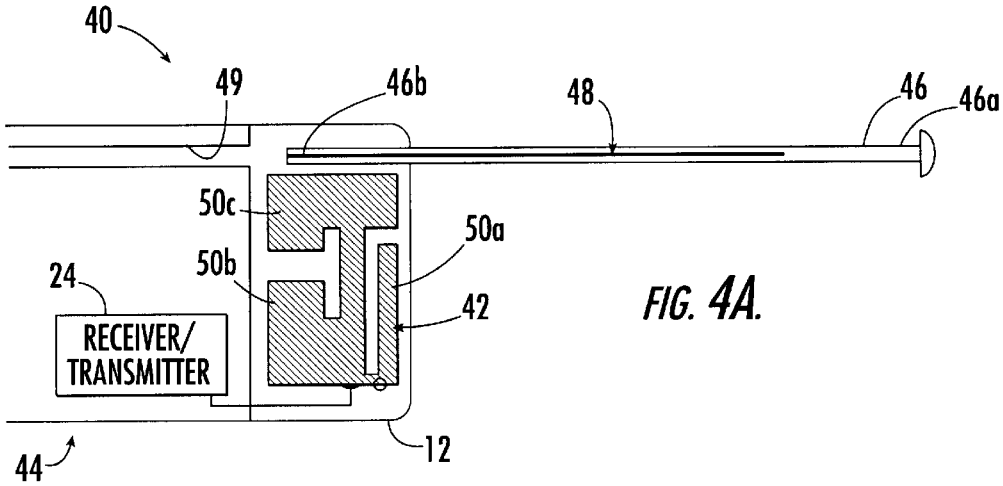
FIGS. 4A–4B are cutaway lateral views of a communications device having an antenna system according to an embodiment of the present invention that includes an internal inverted-F antenna and an elongated antenna member. The retractable antenna member is in an extended position in FIG. 4A and is in a retracted position in FIG. 4B. The internal inverted-F antenna and a conductive element in the elongated antenna member are capacitively coupled when the elongated antenna member is in the extended position of FIG. 4A.
Figure 4B:
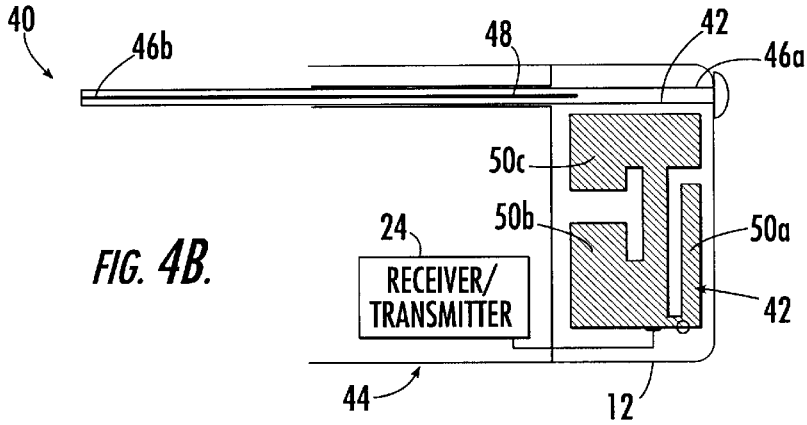

Referring now to FIGS. 4A–4B, an antenna system 40 for use within wireless communication devices such as radiotelephones is illustrated. As illustrated in FIG. 4A, the antenna system 40 includes a multi-frequency band antenna 42 disposed within the housing 12 of a radiotelephone 44. The multi-frequency band antenna 42 is electrically connected with a transceiver 24 also disposed within the housing 12 and illustrated schematically. An elongated antenna member 46 having a free end **46*a* and an opposite end 46*b* is movably mounted within the housing 12 and is extendible from the housing 12 so as to have an extended position (FIG. 4A) and a retracted position (FIG. 4B**).

The elongated antenna member 46 includes an elongated conductive element 48 that does not extend all the way to the free end **46*a*, as illustrated in FIGS. 4A–4B. The conductive element 48 is capacitively coupled with the multi-frequency band antenna 42 when the elongated antenna member 46 is in the extended position (FIG. 4A). The multi-frequency band antenna 42 is electrically isolated from the elongated conductive element 48 when the elongated antenna member is in the retracted position (FIG. 4B**).

As would be understood by those of skill in the art of retractable antennas, the elongated antenna member 46 according to the present invention is configured to slide within an internal passageway or channel 49 formed within the radiotelephone housing 12. Internal channel 49 may have various configurations, and preferably is configured such that the elongated antenna member 46 can be maintained at an extended position and can be maintained at a retracted position.

Figure 5:
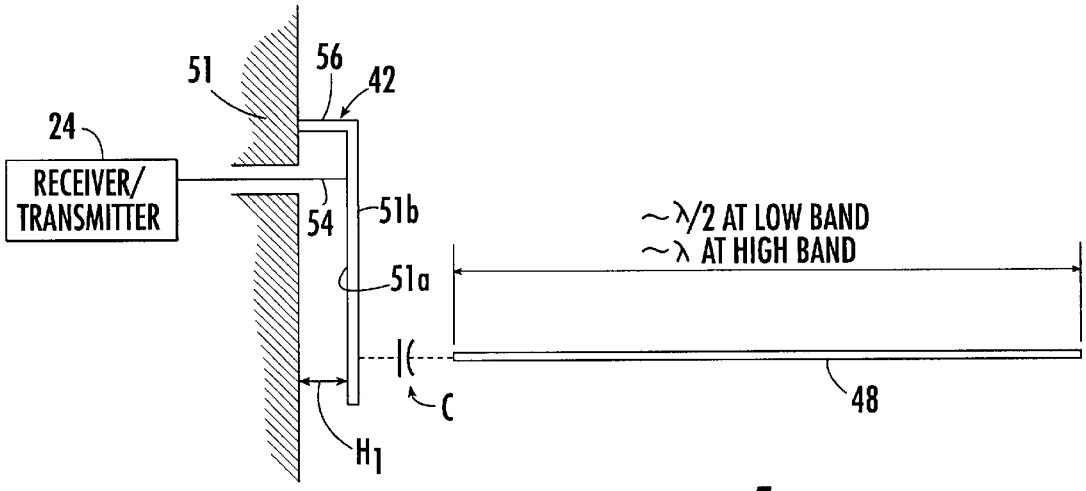
FIG. 5 is an electrical diagram illustrating a conductive element of the elongated antenna member of FIGS. 4A–4B capacitively coupled with an inverted-F antenna, according to an embodiment of the present invention.

In the illustrated embodiment, the multi-frequency band antenna 42 is an inverted-F antenna. The illustrated inverted-F antenna 42 includes a plurality of planar conductive elements 50*a*, 50*b*, 50*c*. Each of the planar conductive elements 50*a*, 50*b*, 50*c* has respective opposite first and second sides 51*a*, 51*b* and is maintained in adjacent, spaced-apart relationship with a ground plane 51 (e.g., a printed circuit board or shield can overlying a printed circuit board) within the housing 12 as illustrated in FIG. 5. The planar conductive elements 50*a*–50*c* are typically maintained spaced-apart from the ground plane 51 by a distance $H_1$, which may be as large as possible, and typically between about 4 millimeters (mm) and about 12 mm. A housing is not illustrated in FIG. 5 for clarity.

Referring to FIG. 5, a signal feed 54 is electrically connected to one of the planar conductive elements 50*a*–50*c* and extends outwardly from the first side 51*a*, thereof, and electrically connects the inverted-F antenna 42 to a transceiver 24. A ground contact 56 also extends outwardly from the first side 51*a* of one of the planar conductive elements 50–50*c* adjacent the signal feed 54 and grounds the inverted-F antenna 42 via the ground plane 51.

As would be understood by those of skill in the art, an inverted-F antenna may be formed on a dielectric substrate, for example by etching a metal layer or layers in a pattern on the dielectric substrate. Also, as would be understood by those of skill in the art, an inverted-F antenna may have one or more conductive elements disposed within a dielectric substrate.

An exemplary material for use as a dielectric substrate for an inverted-F antenna is FR4 or polyimide, which is well known to those having skill in the art of communications devices. However, various other dielectric materials also may be utilized. Preferably, a dielectric substrate has a dielectric constant between about 2 and about 4. However, it is to be understood that dielectric substrates having different dielectric constants may be utilized.

A preferred conductive material out of which the various planar conductive elements 50*a*–50*c* of the illustrated inverted-F antenna 42 may be formed is copper. For example, the various planar conductive elements 50*a*–50*c* may be formed from copper sheet. Alternatively, the various planar conductive elements 50*a*–50*c* may be formed from a copper layer on a dielectric substrate. However, planar conductive elements for inverted-F antennas according to the present invention may be formed from various conductive materials and are not limited to copper.

Inverted-F antennas that may be utilized in antenna systems 40 according to embodiments of the present invention may have various shapes, configurations, and sizes. Exemplary inverted-F antenna shapes and configurations are described and illustrated in a co-pending and co-assigned U.S. Patent Application entitled: "Inverted-F Antennas With Multiple Planar Radiating Elements And Wireless Communicators Incorporating Same", Attorney Docket No. 8194-390, filed Apr. 4, 2000, which is incorporated herein by reference in its entirety.

Preferably, the inverted-F antenna 42 is configured to resonate within a first (i.e., low) frequency band having a first central frequency and within a second (i.e., high) frequency band having a second central frequency, wherein the second central frequency is greater than the first central frequency. As illustrated in FIG. 5, when the elongated antenna member 46 is in the extended position (FIG. 4A), the elongated conductive element 48 is configured to resonate as a half-wave monopole antenna when the inverted-F antenna 42 resonates within the first frequency band. The elongated conductive element 48 is configured to resonate as a full-wave monopole antenna when the inverted-F antenna 42 resonates within the second frequency band.

Figure 6:
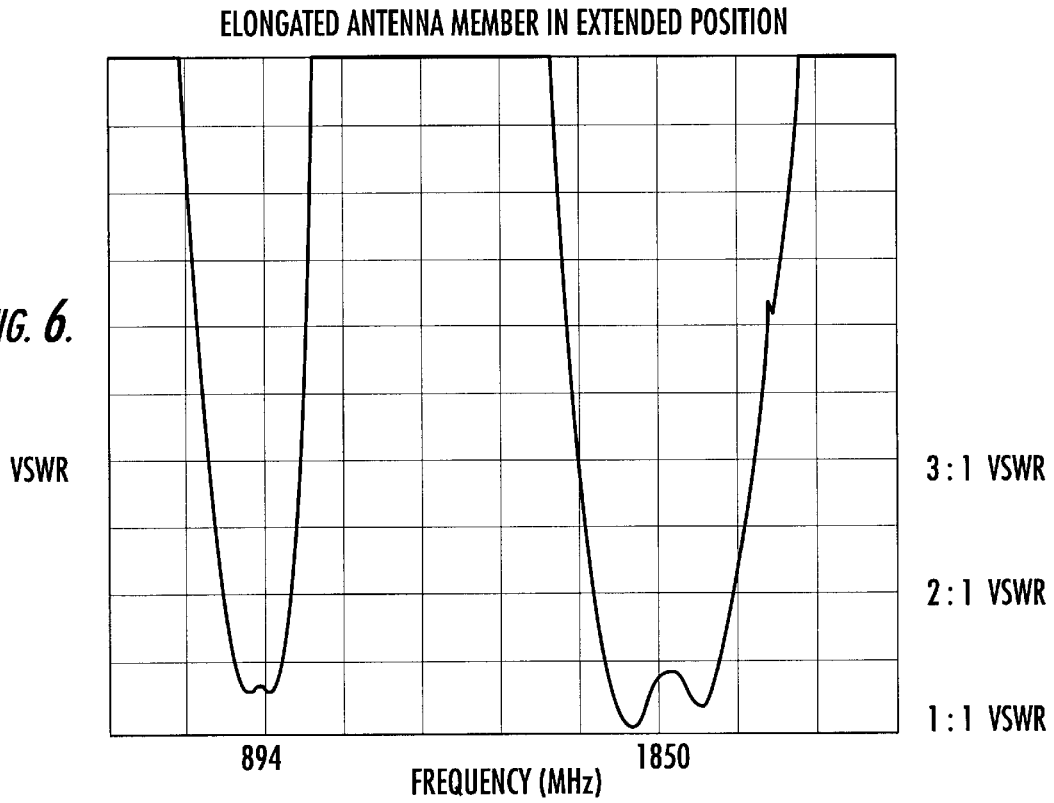
FIG. 6 is a graph of the VSWR performance of the antenna system of FIGS. 4A–4B wherein the elongated antenna member is in an extended position such that the inverted-F antenna and the conductive element of the elongated antenna member are capacitively coupled.
Figure 7:
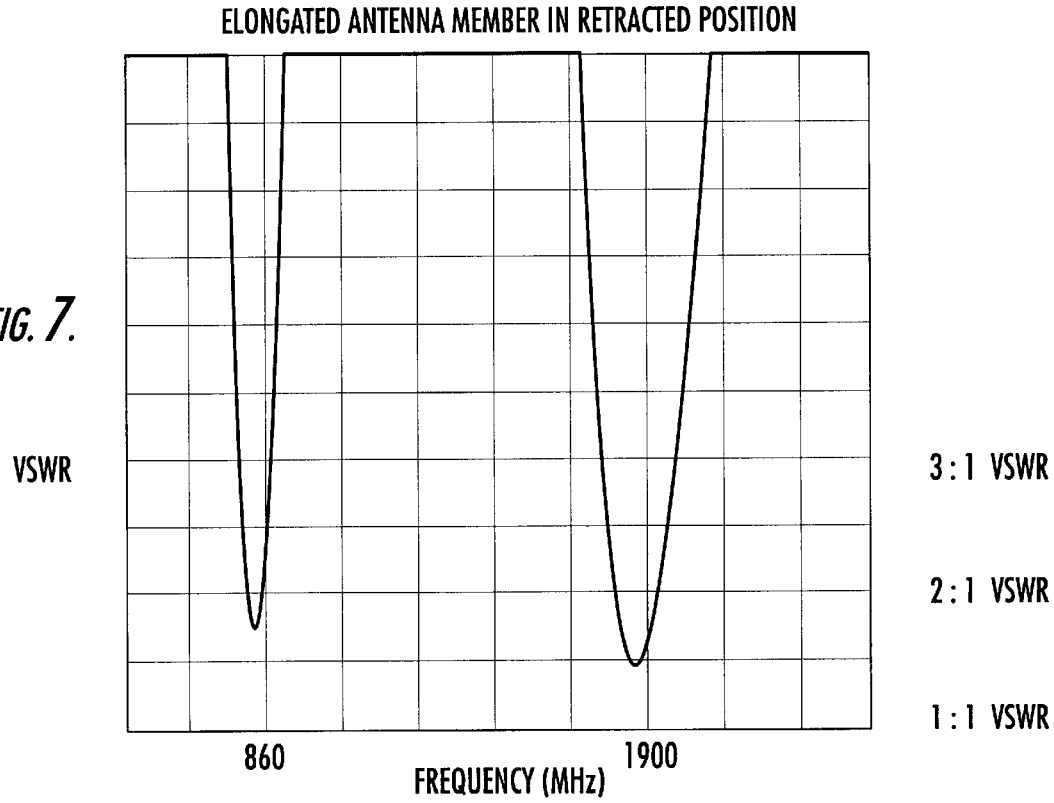
FIG. 7 is a graph of the VSWR performance of the antenna system of FIGS. 4A–4B wherein the retractable antenna is in a retracted position such that the inverted-F antenna and the conductive element of the elongated antenna member are not capacitively coupled.

FIG. 6 illustrates a graph of the VSWR performance of the antenna system of FIGS. 4A–4B wherein the elongated antenna member 46 is in an extended position such that the inverted-F antenna 42 and conductive element 48 of the elongated antenna member 46 are capacitively coupled. FIG. 7 illustrates a graph of the VSWR performance of the antenna system of FIGS. 4A–4B wherein the elongated antenna member 46 is in a retracted position such that the inverted-F antenna 42 and conductive element 48 of the elongated antenna member 46 are not capacitively coupled.

The antenna system represented by the graph of FIG. 6 resonates around 894 MHz and around 1850 MHz. The antenna system represented by the graph of FIG. 7 resonates around 860 MHz and around 1900 MHz. However, it is understood that the frequency bands within which antenna systems 40 according to the present invention may resonate may be adjusted by changing the shape, length, width, spacing and/or configuration of the conductive elements of the inverted-F antenna 42 and/or the conductive element 48 of the elongated antenna member 46. As is illustrated, antenna systems according to the present invention have much broader resonance when the elongated antenna member 46 is in the extended position than when in the retracted position.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna system for a wireless communicator, wherein the wireless communicator includes a housing configured to enclose a receiver that receives wireless communications signals or to a transmitter that transmits wireless communications signals, wherein the antenna system comprises:

an antenna configured to be disposed within the housing and electrically connected with the receiver or transmitter; and an elongated antenna member configured to be movably mounted within the housing and extendible from the housing so as to have an extended position and a retracted position, wherein the elongated antenna member comprises a free end, wherein the elongated antenna member comprises a conductive element that is capacitively coupled with the antenna when the elongated antenna member is in the extended position, wherein the antenna is electrically isolated from the conductive element when the elongated antenna member is in the retracted position, wherein the antenna system resonates around a central frequency in a first frequency band when the elongated antenna member is in the retracted position, and wherein the antenna system resonates around the central frequency in a second frequency band that is wider than the first frequency band when the elongated antenna member is in the extended position.

2. The antenna system according to claim 1 wherein the antenna comprises a multi-frequency band antenna.

3. The antenna system according to claim 1 wherein the antenna comprises an inverted-F antenna.

4. The antenna system according to claim 3 wherein the inverted-F antenna comprises:

a planar conductive element having opposite first and second sides;

a signal feed electrically connected to the planar conductive element and extending outwardly from the planar conductive element first side; and a ground contact electrically connected to the planar conductive element adjacent the signal feed and extending outwardly from the planar conductive element first side.

5. The antenna system according to claim 4 wherein the planar conductive element is disposed on a dielectric substrate.

6. The antenna system according to claim 4 wherein the planar conductive element is disposed within a dielectric substrate.

7. The antenna system according to claim 3 wherein the inverted-F antenna comprises a plurality of planar conductive elements.

8. The antenna system according to claim 1 wherein the conductive element extends partially within the elongated antenna member towards the free end.

9. An antenna system for a wireless communicator, wherein the wireless communicator includes a housing configured to enclose a receiver that receives wireless communications signals or to a transmitter that transmits wireless communications signals, wherein the antenna system comprises:

a dual-band inverted-F antenna configured to be disposed within the housing and electrically connected with the receiver or transmitter, wherein the dual-band inverted-F antenna is configured to resonate within a first frequency band having a first central frequency and within a second frequency band having a second central frequency, wherein the second central frequency is greater than the first central frequency; and an elongated antenna member configured to be movably mounted within the housing and extendible from the housing so as to have an extended position and a retracted position, wherein the elongated antenna member comprises a free end, wherein the elongated antenna member comprises a conductive element that extends partially within the elongated antenna member towards the free end, wherein the conductive element is capacitively coupled with the dual-band inverted-F antenna when the elongated antenna member is in the extended position, wherein the dual-band inverted-F antenna is electrically isolated from the conductive element when the elongated antenna member is in the retracted position, wherein the conductive element is configured to resonate as a half-wave monopole antenna when the multi-frequency band antenna resonates within the first frequency band, wherein the conductive element is configured to resonate as a full-wave monopole antenna when the dual-band inverted-F antenna resonates within the second frequency band, and wherein the first and second frequency bands are wider when the elongated antenna member is in the extended position than when the elongated antenna member is in the retracted position.

10. The antenna system according to claim 9 wherein the inverted-F antenna comprises:

a planar conductive element having opposite first and second sides;

a signal feed electrically connected to the planar conductive element and extending outwardly from the planar conductive element first side; and a ground contact electrically connected to the planar conductive element adjacent the signal feed and extending outwardly from the planar conductive element first side.

11. The antenna system according to claim 10 wherein the planar conductive element is disposed on a dielectric substrate.

12. The antenna system according to claim 10 wherein the planar conductive element is disposed within a dielectric substrate.

13. The wireless communicator according to claim 12 wherein the wireless communicator comprises a radiotelephone.

14. The antenna system according to claim 10 wherein the inverted-F antenna comprises a plurality of planar conductive elements.

15. A wireless communicator, comprising:

a housing configured to enclose a receiver that receives wireless communications signals or a transmitter that transmits wireless communications signals;

a multi-frequency band antenna disposed within the housing and electrically connected with the receiver or transmitter; and an elongated antenna member movably mounted within the housing and extendible from the housing so as to have an extended position and a retracted position, wherein the elongated antenna member comprises a free end, wherein the elongated antenna member comprises a conductive element that is capacitively coupled with the multi-frequency band antenna when the elongated antenna member is in the extended position, wherein the multi-frequency band antenna is electrically isolated from the conductive element when the elongated antenna member is in the retracted position, wherein the antenna system resonates around a central frequency in a first frequency band when the elongated antenna member is in the retracted position, and wherein the antenna system resonates around the central frequency in a second frequency band that is wider than the first frequency band when the elongated antenna member is in the extended position.

16. The wireless communicator according to claim 15 wherein the multi-frequency band antenna comprises an inverted-F antenna.

17. The wireless communicator system according to claim 16 wherein the wireless communicator further comprises a ground plane disposed within the housing, and wherein the inverted-F antenna comprises:

a planar conductive element having opposite first and second sides and maintained in adjacent, spaced-apart relationship with the ground plane;

a signal feed electrically connected to the planar conductive element and extending outwardly from the planar conductive element first side; and a ground contact electrically connected to the planar conductive element adjacent the signal feed and extending outwardly from the planar conductive element first side.

18. The wireless communicator according to claim 17 wherein the planar conductive element is disposed on a dielectric substrate.

19. The wireless communicator according to claim 17 wherein the planar conductive element is disposed within a dielectric substrate.

20. The wireless communicator according to claim 17 wherein the inverted-F antenna comprises a plurality of conductive elements maintained in adjacent, spaced-apart relationship with the ground plane.

21. A wireless communicator, comprising:

a housing configured to enclose a transceiver that transmits and receives wireless communications signals;

a ground plane disposed within the housing;

a dual-band inverted-F antenna disposed within the housing and electrically connected with the transceiver, wherein the dual-band inverted-F antenna is configured to resonate within a first frequency band having a first central frequency and within a second frequency band having a second central frequency, wherein the second central frequency is greater than the first central frequency; and an elongated antenna member movably mounted within the housing and extendible from the housing so as to have an extended position and a retracted position, wherein the elongated antenna member comprises a conductive element that is capacitively coupled with the dual-band inverted-F antenna when the elongated antenna member is in the extended position, wherein the dual-band inverted-F antenna is electrically isolated from the conductive element when the elongated antenna member is in the retracted position, and wherein the conductive element is configured to resonate as a half-wave monopole antenna when the multi-frequency band antenna resonates within the first frequency band, and wherein the conductive element is configured to resonate as a full-wave monopole antenna when the dual-band inverted-F antenna resonates within the second frequency band, and wherein the first and second frequency bands are wider when the elongated antenna member is in the extended position than when the elongated antenna member is in the retracted position.

22. The wireless communicator according to claim 21 wherein the inverted-F antenna comprises:

a planar conductive element having opposite first and second sides and maintained in adjacent, spaced-apart relationship with a ground plane within the housing;

a signal feed electrically connected to the planar conductive element and extending outwardly from the planar conductive element first side; and a ground contact electrically connected to the planar conductive element adjacent the signal feed and extending outwardly from the planar conductive element first side.

23. The wireless communicator according to claim 22 wherein the planar conductive element is disposed on a dielectric substrate.

24. The wireless communicator according to claim 22 wherein the planar conductive element is disposed within a dielectric substrate.

25. The wireless communicator according to claim 22 wherein the inverted-F antenna comprises a plurality of conductive elements maintained in adjacent, spaced-apart relationship with a ground plane within the housing.

26. The wireless communicator according to claim 21 wherein the wireless communicator comprises a radiotelephone.

* * * * *